United States Patent [19]

Moriyama

[11] 4,074,165

[45] Feb. 14, 1978

[54] DECORATIVE LIGHT SOURCE INCLUDING A DISCHARGE LAMP AND RESISTOR WITHIN AN OUTER ENVELOPE

[75] Inventor: Hideo Moriyama, Tokyo, Japan

[73] Assignee: Moriyama Sangyo Kabushiki Kaisha, Tokyo, Japan

[21] Appl. No.: 684,253

[22] Filed: May 7, 1976

[30] Foreign Application Priority Data

May 23, 1975 Japan ..... 50-62384
Oct. 17, 1975 Japan ..... 50-125045

[51] Int. Cl.[2] ..... H01J 61/34; H01J 61/35; H01J 61/40; H01J 61/56

[52] U.S. Cl. ..... 313/112; 362/810; 313/116; 313/220; 313/318; 315/71

[58] Field of Search ..... 313/110–112, 313/116, 210, 220, 221, 312, 317, 318; 315/71; 240/10 R, 10 B, 13, 17

[56] References Cited

U.S. PATENT DOCUMENTS

| | | | |
|---|---|---|---|
| 372,313 | 11/1887 | Haines | 313/116 |
| 3,435,286 | 3/1969 | Kayatt | 313/317 X |
| 3,514,660 | 5/1970 | Kopelman | 313/210 X |
| 3,896,326 | 7/1975 | Fohl | 313/220 |

FOREIGN PATENT DOCUMENTS

| | | | |
|---|---|---|---|
| 937,825 | 9/1963 | United Kingdom | 313/116 |

*Primary Examiner*—Siegfried H. Grimm
*Attorney, Agent, or Firm*—Oblon, Fisher, Spivak, McClelland & Maier

[57] ABSTRACT

An illuminating device used for decorating purposes comprises a base for electrical and mechanical connection to a socket, a discharge tube or bulb, a discharge control element for the discharge tube or bulb, supporting wires to support the discharge tube or bulb and the discharge control element, and a light transmitting envelope to be received in the base covering the discharge tube or bulb, the discharge control element and the supporting wires therewithin.

20 Claims, 12 Drawing Figures

DECORATIVE LIGHT SOURCE INCLUDING A DISCHARGE LAMP AND RESISTOR WITHIN AN OUTER ENVELOPE

BACKGROUND OF THE INVENTION

1. Field of the Invention

The present invention relates to illuminating devices having a taper-like imitation flame for decorating purposes.

2. Description of the Prior Art

It has been proposed, as a taper-like imitation flame, to use a flame-shaped envelope instead of the conventional spherical glass envelope of the incandescent lamp and to mount it on a taper post with a candlestand. This type of illumination lamp is aimed to be used singly or a few lamps are used at a time. However, due to the shape or appearance, the use of such lamp is much limited and is not suitable for illumination in a room or for window display. Also, the lamp itself is not an ordinary lamp and it necessarily uses special wiring or connecting means for power supply, and therefore the use thereof has been further limited. On the other hand, in order to use many lamps at a time in a chandelier, it has been proposed to apply a base shell to the bottom end of the taper post and to use a separate cover over a smaller but ordinary incandescent lamp in Japanese Utility Model Registration No. 729,931. According to this lamp, the imitation effect of the envelope was not sufficient. In other words, when the lamp is lit, the envelope thereof really shows the flame shape. However, its light source is still static and cannot show a taper like glimmering or flickering flame. Further, since the outer shape is so distinct, its imitation effect has been rather poor.

In this connection, in order to obtain better imitation effect, it has been proposed that the outer surface of the flame-shaped cover is arranged to be closely wound with fine glass fibers and to be adhered and fixed, as shown in U.S. Pat. No. 3,127,295, thereby moderating the distinct outer shape. In order to lessen the manufacturing cost for the above type of lamp, it has been further proposed, in Japanese Utility Model Publication No. 37403/1972, that the cover is formed in two axially separate portions by molding synthetic resin and, at the time of molding, concentric stripes or a spiral line are, or is, formed around the inner surface of the cover.

It has been proposed, in Japanese Utility Model Laid-open No. 150580/1974, that a light source bulb, such as a torpedo shaped bulb, is covered by a evacuated globe bulb. In these conventional examples using covers over electric bulbs, since the electric bulbs are incandescent lamps and covers are applied thereover, there has occurred a problem of heat dissipation and the lighting life, ordinarily of 1200 – 1800 hours, will be shortened. Especially the lighting life of the evacuated globe type bulb will be shortened to half of the ordinary lighting life. As a result, when many lamps are used, bulbs must be exchanged often, thus making these kinds of lamps improper to be used in a chandelier or other illumination means suspended from a ceiling or supported in the show window. Such repeated exchanging of bulbs in these cases is very troublesome.

As a special decorative lamp, there has been proposed, in Japanese Utility Model Registration No. 411644, a neon lamp wherein neon discharge electrodes of a peculiar shape are used in a radiation part of the lamp and discharge arc between the opposing electrodes is made to unstably move to and fro from time to time. In this case, however, the discharge electrodes are plate-shaped and face each other, and therefore although the light source is seen from the facing side as a facial light, from the side of the electrodes, light is seen as a mere arc between the two line-form electrodes. Further, when the neon lamp is mounted by rotating its screwed base into the socket, the direction of light source is not constant. Since the move in the radiation part is too frequent, when many lamps are used simultaneously, visual flickers are large so as to obstruct the usage in a chandelier. Further, since the discharge thereof is very unstable, and its discharge portion moves frequently, brightness is weak and much illumination effect is not expected.

SUMMARY OF THE INVENTION

Accordingly, the primary object of this invention is to provide an illuminating device using an ordinary neon bulb which gives a taper like imitation flame for decorating purposes.

Another object of this invention is to provide an illumination device which can be easily mass-produced and for which the exchange procedure thereof is rather simple.

Still another object is to provide an illumination device wherein the discharged light from the neon bulb is controlled as to give taper-like glimmering.

BRIEF DESCRIPTION OF THE DRAWINGS

Other characteristics according to the present invention will be more apparent from the embodiments described hereinunder, reference being made to the accompanying drawings. In the drawings.

DETAILED DESCRIPTION OF THE ILLUSTRATED EMBODIMENTS

Figure 1:
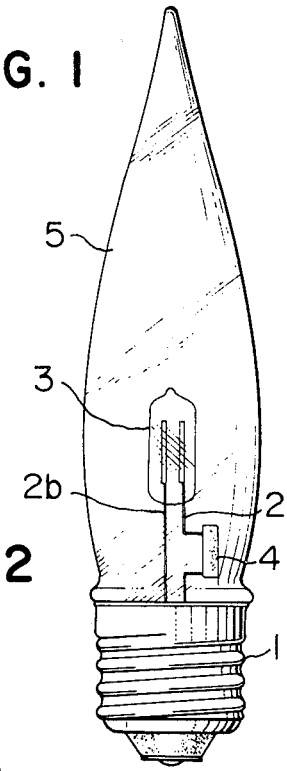
FIG. 1 shows an illumination lamp according to the present invention of a single discharge tube or bulb.

In the embodiment of FIG. 1, a neon bulb is used as a light source. The bulb emits a flame-like reddish light when it is lit. To a base 1 are connected, by soldering, two lead-in wires 2a and 2b at each lowermost end for eletrical and firm mechanical connection. The other end of the lead-in wire 2a is directly connected to an outgoing wire of one of electrodes of a neon bulb 3 and the other lead-in wire 2b is connected to an outgoing wire of another electrode of the neon bulb 3. A resistor 4 is inserted into the lead-in wire 2a. The outgoing wires can be used also as the respective lead-in wires if they can be elongated. The resistance of the resistor 4 is selected to define proper gas discharge. When this neon bulb 3 is lit by a D.C. power source, the resistance and the small capacitance determined by the configuration of the electrodes, define the gas discharge time constant, and when the neon bulb is lit by on A.C. power source, the discharge cycle depends on the power source frequency.

In order to obtain a good taper-like glimmering effect, the resistance may be chosen to be higher than that of ordinary resistance, which gives a good stable discharge state. The wires 2a and 2b may be bent or coiled when they are inserted into the base in order to keep proper positional relation of the neon lamp 3 with respect to the base.

The illumination lamp according to the present invention may thus be lit with the neon bulb 3 inserted into the base 1 when it is applied to the socket, now shown. However, for getting better appearance and also easier lamp-mount and dismount construction, and for avoiding any electrical shock at the bare electrical wiring, as the lead-in wires 2a, 2b, or any short circuit due to the displacement of the neon bulb supporting means by any shock from outside, over these parts a light transmitting envelope 5 is mounted, and its neck part is inserted with pressure into the opening of the base 1. The connection of the neck part of the envelope and the base is not necessarily airtight, and so the inner space of the envelope is not evacuated. The light transmitting envelope is made by injection molding or blow molding. The envelope 5 is a spindle-shaped member made of transparent or transluscent synthetic resin or glass, and around the outer or inner surface thereof, stripes, ditches, etc., may be applied during the molding process, or after the process, as is well known. Fixation to the base is made by known methods, such as by some engaging means and with some adhering agent. The outer shape of the neon bulb 3 itself may be formed as a taper-like shape or a torpedo-like shape.

Figure 2:
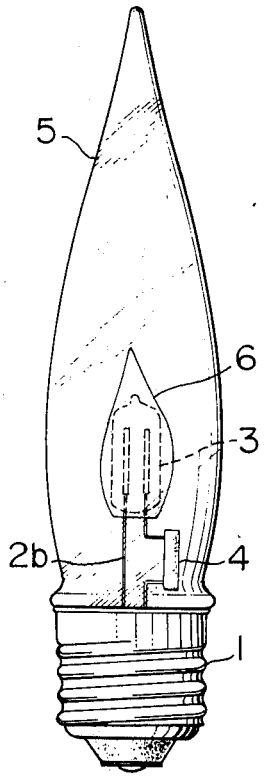
FIG. 2 shows the illumination lamp wherein a flame-shaped member is mounted over the discharge tube or bulb of FIG. 1.
Figure 3:
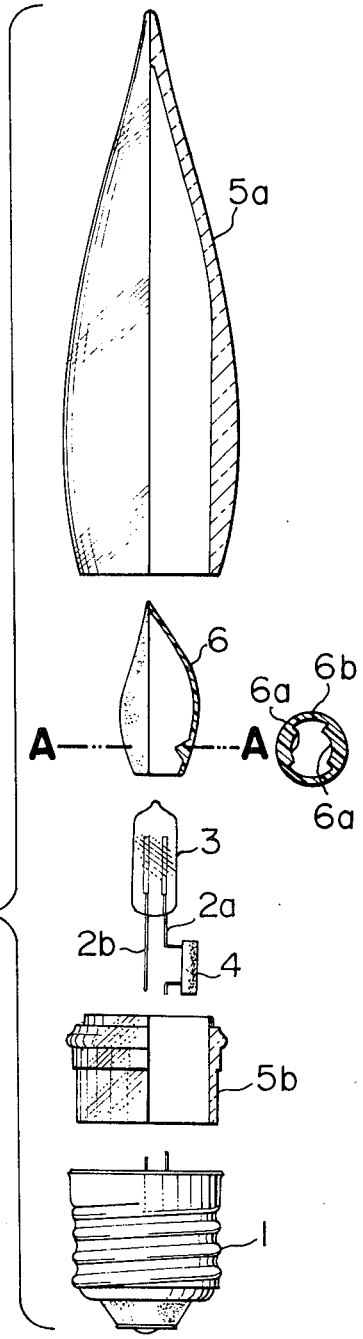
FIG. 3 shows an exploded view of the illumination lamp wherein the light transmitting envelope consists of two separate parts.

FIG. 2 shows another improved embodiment according to the present invention. Identical reference numerals are used as in FIG. 1 to show identical parts. In this embodiment, over the neon bulb is mounted a flame-shaped member 6 of resilient synthetic resin, which is a colored (mainly to red) hollow member. The size of the inner surface of the hollow member is almost the same as the outer size of the neon bulb 3 so that, when the neon bulb 3 is inserted thereinto, the neon bulb will not be easily slipped off. Thus this flame-shaped member 6 is mounted as to cover the entire neon bulb 3. As shown in FIG. 3 in sectional views, the lowerside of the flame-shaped member 6 may be provided with inwardly protruding portions for tight mounting over the neon bulb 3. The flame-shaped member 6 may integrally include at its under end part a skirt, so that the skirt part (not shown) when mounted fully covers or conceals the lead-in wires and the resistor 4. Of course, this skirt or envelope part may be formed as a separate member to be mounted over the embodiment of FIG. 1. When the illumination lamp according to the present invention is mounted to a socket of a chandelier construction through its base 1, radiation light of the neon bulb 3, of a warm-colored and from a relatively wide area, in the embodiment of FIG. 1, is softened by the light transmitting envelope 5, light reflection at the inner surface of the envelope, light refraction at the outer surface of the envelope, and/or light diffusion at the inner and top of the envelope, so as to soften the distinct configuration of the envelope. Moreover, the entire envelope, up to its top, is illuminated by its optical property such as reflection and refraction and so its decorative imitation effect is noted to a higher extent. The illumination lamp according to the present invention has nearly permanent lighting life, except for the case of an unexpected accident. Thus, it suits for a chandelier lamp suspended from the ceiling, where maintenance work is troublesome.

According to the embodiment of FIG. 2, with the flame-shaped cover 6 mounted over the neon bulb 3, the imitation effect is further improved. In other words, the radiating light from the neon bulb appears through the flame-shaped member 6 as a larger three-dimensional light source of the entire flame-shaped member 6, and, as a result, the optical function of the above mentioned light transmitting envelope 5 is further influenced with the broader light source and the light reflection at the wall of the inner cover 6. The inner part of the envelope 5 is thus seen as a finite light source and shows a particular imitation effect.

FIG. 3 shows an embodiment of a further improved illumination lamp, according to the present invention, in an exploded form. In this embodiment, the light transmitting envelope 5 consists of the upper part 5a enveloping the neon lamp 3 and the neck part 5b to be inserted into the base 1, the upper enveloping part 5a being formed by blow molding or injection molding. With this construction, only an outer swelling portion of the spindle shape may be made thick, as shown in the drawing. Thus, the separate enveloping part 5a and the neck part 5b are assembled by contacting respective opening ends and fixed to each other by adhering or welding, in order to obtain an integral envelope, as shown in the foregoing embodiments. According to this embodiment, light at the enveloping part 5a of the light transmitting envelope 5 distorts, by its lens effect, the image of the inner cover 6, and also light is diffused at that part and, due to the change of visual angle, the illumination lamp according to the present invention shows an imitation effect.

There are marketed various size and shape of the bases of the lamp. In the case of the so-called Edison type screw base, there are considerably many types as E10, E12, E14, E17, E26, E39, etc., wherein E shows the Edison type screw base and the numerals respective nominal diameters (in milimeter).

Figure 4:
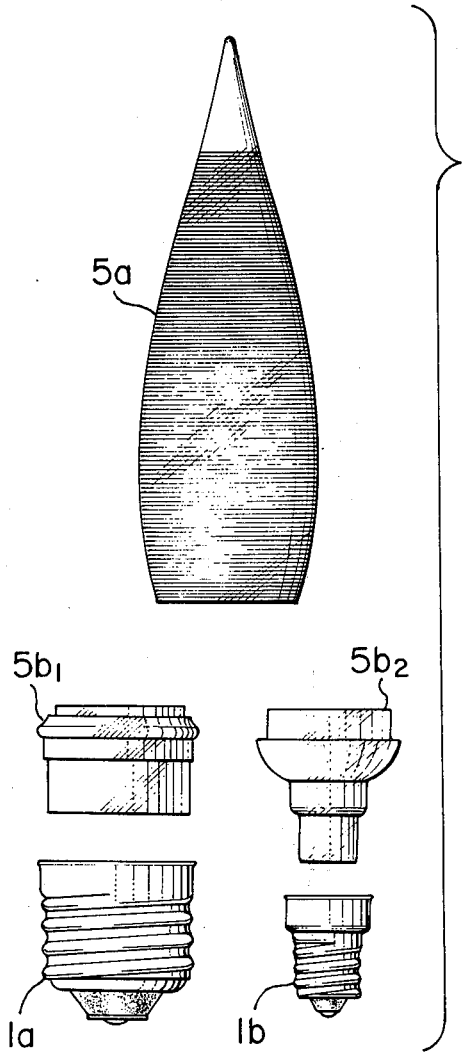
FIG. 4 shows the upper part of the light transmitting envelope, two different bases and corresponding neck parts.

With the thus separated construction of the light transmitting envelope 5, if some kinds of the neck parts 5b are made with respective engaging parts for the different sizes of bases (particularly in respect of the size of the bases and engaging means with the bases), the same upper enveloping part 5a may be used for any of the bases 1, irrespective of the sizes thereof. In such case, the neck parts 5b1 or 5b2, as shown in FIG. 4, must have opening ends of diameter the same as that of the bottom opening of the enveloping part 5a. The assembling of these separate parts is easy and the construction is suitable for mass-production with lower cost. The upper enveloping part 5a may thus be constructed irrespective of the sizes of the bases, and so can completely cover the neon bulb, which cannot be made extremely small, and the lighting control member, as the resistor therewithin.

Figure 5:
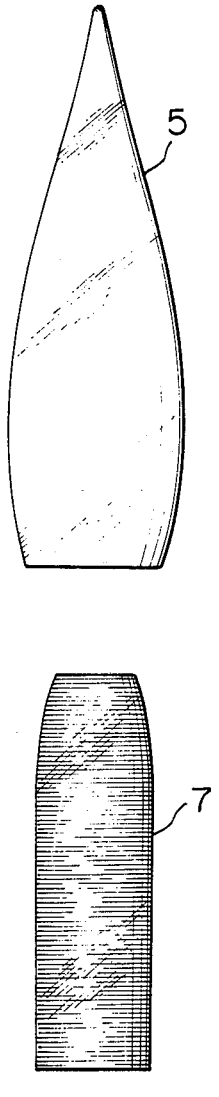
FIG. 5 shows the upper envelope and an inner drum of the envelope to be inserted thereinto.

In the embodiment of the enveloping part 5a shown in FIG. 4 stripes or grooves are provided around the outer surface of the enveloping part, but as mentioned before, such stripes or grooves may be provided around the inner surface of the enveloping part 5a. As a further modified embodiment, there is shown, in FIG. 5, a transparent or transluscent thin drum-shaped member 7, with the stripes or grooves either on its outer or inner surface, which is inserted into the light transmitting envelope 5.

Figure 6:
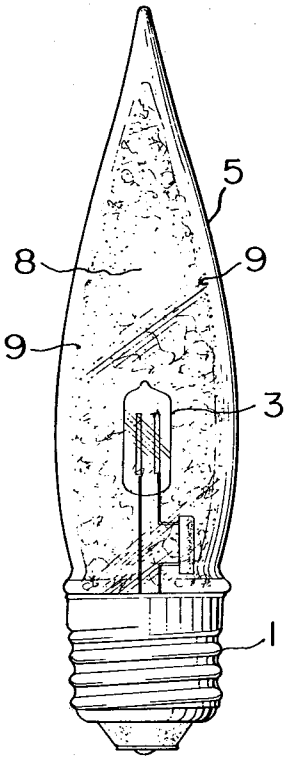
FIG. 6 shows the illumination lamp wherein fine fibers and/or glass particles are filled or attached within the envelope.

In an embodiment shown in FIG. 6, transparent or translucent fine fibers 8 of, for example, glass fibers, are filled within the inner hollow space of the light transmitting envelope 5. The fine fibers 8 may be attached to the inner surface of the envelope 5. In place of the fine fibers 8, or together therewith, transparent or transluscent particles 9, for example, of glass beads, may be attached to the inner surface of the light transmitting envelope 5, as is shown in FIG. 6. With this embodiment, by the optical function of the light refracting material, such as the fine fibers 8 and the particles 9, there occurs diffused reflection of the source light or special diffusion of light within the light transmitting envelope 5, which provides a distinguished imitation effect, as well as decorative effect.

Figure 8:
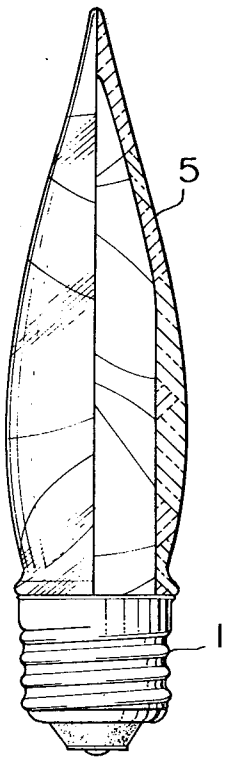
FIG. 8 shows the illumination lamp wherein the envelope is formed mixedly with a colored part and the transparent part.
Figure 7:
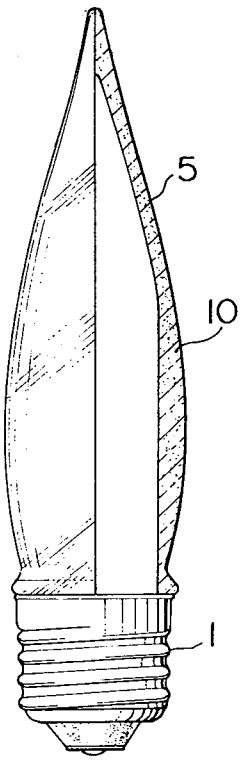
FIG. 7 shows the illumination lamp wherein the metallic particles are mixed into its wall, inner parts as the discharge tube or bulb being eliminated.

In the embodiment shown in FIG. 7, very fine metallic particles 10, other than the above optical light refracting material, is mixed into the wall body of the light transmitting envelope 5 at the time of molding thereof, thereby a particular optical effect is obtained by light refraction or light reflection. These metallic particles may be attached around the outer surface of the light transmitting envelope. FIG. 8 shows an embodiment of the light transmitting envelope 5 whose peripheral wall mixedly consists of resin material colored with pigment and of transparent resin material. With this envelope, particular decorative effect is obtainable. The color pigment may be provided around the outer surface of the envelope.

Figure 9:
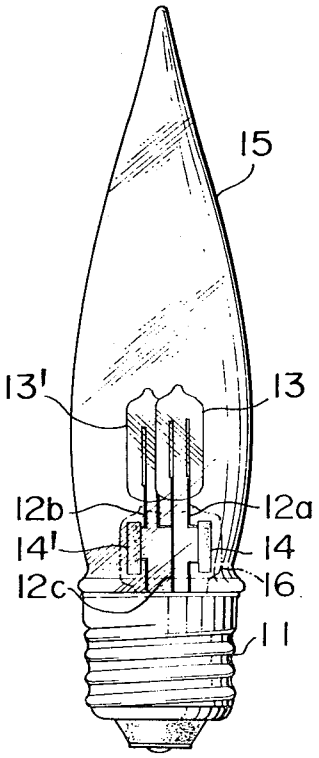
FIG. 9 shows the illumination lamp according to the present invention of two discharge tubes or bulbs.

The embodiment shown in FIG. 9 uses two neon bulbs 13, 13' instead of a single neon bulb 3 as in the foregoing embodiments. In this case, three lead-in wires 12a, 12b and 12c are connected to a base 11 and, among these the, lead-in wire 12c is commonly used for the two bulbs. Resistors 14, 14' are inserted into the lead-in wires 12a and 12b for maintaining gas discharge of the bulbs 13, 13', respectively. In this drawing, the bulbs 13, 13' are shown as disposed parallel to each other. However, they may be disposed so that one of them is disposed over the other. The width and height of the source light may thus be varied. In the present embodiment, a skirt 16, shown in dotted line, of synthetic resin, which is contracted by heat, is provided to cover the resistors and the lead-in wires. The structure of a light transmitting envelope 15, together with its modified examples, is the same as already explained in the foregoing explanation for the embodiments. The envelope 15 is inserted, as in the other foregoing embodiments, into the base 11.

Figure 10:
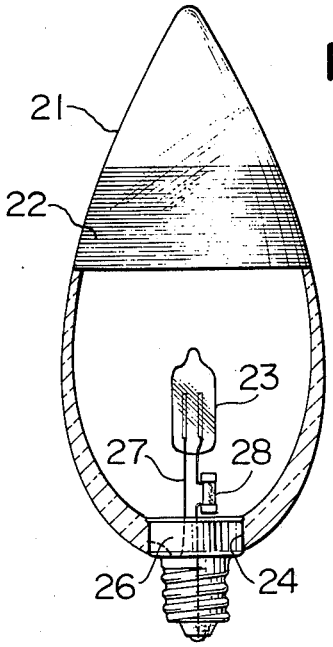
FIG. 10 shows the illumination lamp with the light transmitting envelope of different configuration.
Figure 11:
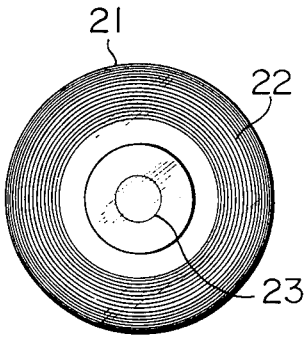
FIG. 11 shows the illumination lamp with the light transmitting envelope of lamp-chimney shape.
Figure 11:
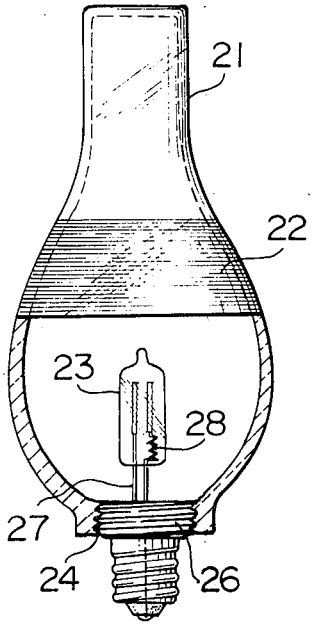
Figure 12:
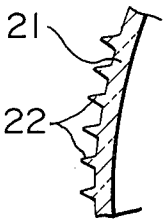
FIG. 12 shows the enlarged sectional view of the envelope of FIG. 10.

In the embodiments of FIGS. 10 and 11, light transmitting envelopes 21 of different configuration are used. FIG. 10 uses an egg-shaped envelope, while FIG. 11 uses a lamp chimney-shaped envelope. Around the outer surfaces of these envelopes 22 of FIGS. 10 and 11, fine spiral protrusions are provided, as in FIG. 12, shown in an enlarged partial sectional view. The protrusions are formed for obtaining an optical effect. The spiral pitch is about 0.5 millimeter and the top angle of the protrusion is, for example, between 70° to 90°. The numeral 23 is a neon bulb. The numeral 28 is a resistor. In FIG. 10, the resistor 28 is inserted between the discharge electrode of the bulb 23 and a base, while in FIG. 11, the resistor 28 is inserted within the bulb 23.

The invention has been described in detail with reference to the preferred embodiments, but it will be understood that variations and modifications can be effected within the spirit and scope of the invention.

What is claimed is:

1. An illuminating device used for decorating purposes which comprises:

a base for electrical and mechanical connection to a socket;

a discharge bulb;

a discharge control element for said discharge bulb;

supporting wires to support said discharge bulb and said discharge control element;

a flame-shaped member mounted over said discharge bulb; and a light transmitting envelope separately comprised of a lower neck part, one end of which is adapted to be received in said base, and an upper enveloping part being attached to the other end of said lower neck part, for covering said discharge bulb, said discharge control element and said supporting wires therewithin.

2. An illuminating device used for decorating purposes which comprises:

a base for electrical and mechanical connection to a socket;

a discharge bulb;

a discharge control element for said discharge bulb;

supporting wires to support said discharge bulb and said discharge control element; and a light transmitting envelope separately comprised of a lower neck part, one end of which is adapted to be received in said base, and an upper enveloping part being attached to the other end of said lower neck part, for covering said discharge bulb, said discharge control element and said supporting wires therewithin, and the upper portion of the light transmitting envelope having comparatively large thickness at least in its central swelling part.

3. An illuminating device according to claim 2, wherein a non-opaque light refracting member is attached to an inner surface of said light transmitting envelope.

4. An illuminating device according to claim 2, wherein an optical material is attached to an outer surface of said light transmitting envelope.

5. An illuminating device according to claim 2, wherein the thickness of a wall of the light transmitting envelope differs along the surface thereof.

6. An illuminating device according to claim 3, wherein said non-opaque light refracting member consists of particles.

7. An illuminating device according to claim 3, wherein said non-opaque light refracting member consists of fine fibers.

8. An illuminating device according to claim 2, wherein a non-opaque light refracting member fills the hollow part of said light transmitting envelope.

9. An illuminating device according to claim 8, wherein said non-opague light refracting member consists of particles.

10. An illuminating device according to claim 8, wherein said non-opaque refracting member consists of fine fibers.

11. An illuminating device according to claim 4, wherein said optical material consists of transparent chips.

12. An illuminating device according to claim 4, wherein said optical material consists of particles.

13. An illuminating device according to claim 4, wherein said optical material consists of pigments.

14. An illuminating device according to claim 2, wherein an optical material is mixed into the wall of the light transmitting envelope.

15. An illuminating device according to claim 14, wherein said optical material consists of transparent chips.

16. An illuminating device according to claim 14, wherein said optical material consists of particles.

17. An illuminating device according to claim 14, wherein said optical material consists of pigments.

18. An illuminating device used for decorating purposes which comprises:

a base for electrical and mechanical connection to a socket;

a discharge bulb;

a discharge control element for said discharge bulb;

supporting wires to support said discharge bulb and said discharge control element;

a flame-shaped member mounted over said dishcarge bulb; and a light transmitting envelope to be received within said base covering said discharge bulb, said discharge control element, said supporting wires and said flame-shaped member therewithin.

19. An illuminating device used for decorating purposes which comprises:

a base for electrical and mechanical connection to a socket;

at least two discharge bulbs;

a discharge control element for each of said discharge bulbs;

supporting wires to support said discharge bulbs and said discharge control elements; and a light transmitting envelope separately comprised of a lower neck part, one end of which is adapted to be received in said base, and an upper enveloping part being attached to the other end of said lower neck part, for covering said discharge bulbs, said discharge control elements and said supporting wires therewithin.

20. An illuminating device used for decorating purposes which comprises;

a base for electrical and mechanical connection to a socket;

a discharge bulb;

a discharge control element for said discharge bulb being in the form of a resistor, which is adjusted to induce unstable discharge in the discharge bulb;

supporting wires to support said discharge bulb and said discharge control element; and a light transmitting envelope separately comprised of a lower neck part, one end of which is adapted to be received in said base, and an upper enveloping part being attached to the other end of said lower neck part, for covering said discharge bulb, said discharge control element and said supporting wires therewithin.

* * * * *